US007046252B2

(12) United States Patent
Nair et al.

(10) Patent No.: US 7,046,252 B2
(45) Date of Patent: May 16, 2006

(54) METHOD AND SYSTEM FOR ADAPTIVE COLOR AND CONTRAST FOR DISPLAY DEVICES

(75) Inventors: Hari Nair, Bangalore (IN); Neha Agrawal, Bangalore (IN); Saif Choudhary, Bangalore (IN); Ashish Neema, Bangalore (IN); Arun Johary, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 0 days.

(21) Appl. No.: 10/810,137

(22) Filed: Mar. 26, 2004

(65) Prior Publication Data

US 2004/0179022 A1 Sep. 16, 2004

Related U.S. Application Data

(63) Continuation of application No. 10/193,348, filed on Jul. 10, 2002, now Pat. No. 6,778,183.

(51) Int. Cl.
*G09G 5/02* (2006.01)

(52) U.S. Cl. ..... 345/590; 348/254; 348/663; 348/672; 348/674

(58) Field of Classification Search ..... 345/589, 345/590; 348/253–258, 565–568, 645–652, 348/663, 667, 671–674, 686–689; 382/167–169, 382/274; 358/519
See application file for complete search history.

(56) References Cited

U.S. PATENT DOCUMENTS

| | | | | |
|---|---|---|---|---|
| 4,386,345 | A | 5/1983 | Narveson et al. | |
| 4,430,665 | A | 2/1984 | Cochran | |
| 4,774,580 | A | 9/1988 | Miyasako | |
| 5,828,793 | A | 10/1998 | Mann | |
| 5,940,544 | A | 8/1999 | Nako | |
| 5,949,918 | A | 9/1999 | McCaffrey | |
| 6,008,794 | A | 12/1999 | Ishii | |
| 6,023,266 | A | 2/2000 | Eglit et al. | |
| 6,151,410 | A * | 11/2000 | Kuwata et al. | 382/167 |
| 6,172,718 | B1 | 1/2001 | Alvarez et al. | |
| 6,181,321 | B1 * | 1/2001 | Zhao et al. | 345/617 |
| 6,239,782 | B1 | 5/2001 | Siegel | |
| 6,351,558 | B1 | 2/2002 | Kuwata | |
| 6,396,504 | B1 | 5/2002 | Yung et al. | |
| 6,400,989 | B1 | 6/2002 | Eckmiller | |
| 6,417,891 | B1 | 7/2002 | Cacciatore et al. | |

FOREIGN PATENT DOCUMENTS

| | | |
|---|---|---|
| JP | 2001134235 | 11/1999 |

* cited by examiner

*Primary Examiner*—Matthew C. Bella
*Assistant Examiner*—G. F. Cunningham
(74) *Attorney, Agent, or Firm*—Beyer Weaver & Thomas, LLP

(57) ABSTRACT

A method and apparatus that allows a display device to adaptively and automatically control display contrast and color is disclosed. The method and system in accordance with the present invention can be described by the following sequential process:

1. Separating an input image data value into its luma and chroma components.
2. Collecting the luma distribution data over the entire image or a specified window.
3. Analyzing the luma distribution.
4. Generating an appropriate contrast control response that modifies the input luma component to generate an output luma component, on a pixel by pixel basis.
5. Analyzing the input luma component and the output luma component, and an input chroma component, to generate an appropriate modification for the chroma component, on a pixel by pixel basis.

20 Claims, 11 Drawing Sheets a - No change in output (Avg brightness $B_A$)
b - Increased contrast, Increased brightness (Avg brightness $B_B$)
c - Decreased contrast, Decreased brightness(Avg brightness $B_C$)

Standard contrast adjustment

Recovering full luma dynamic range ("Snapping")

Dark image template transfer function

Dark image template transfer function

Mid-tone image template transfer function

Mid-tone image template transfer function

Bright image template transfer function

Bright image template transfer function

Representative hardware implementation data path

METHOD AND SYSTEM FOR ADAPTIVE COLOR AND CONTRAST FOR DISPLAY DEVICES

CROSS-REFERENCES TO RELATED APPLICATIONS

This application is a continuation of U.S. application Ser. No. 10/193,348 filed Jul. 10, 2002 now U.S. Pat. No. 6,778,183 entitled "Method and System for Adaptive Color and Contrast for Display Devices" which is hereby incorporated by reference.

FIELD OF THE INVENTION

The present invention relates generally to display devices and particularly to a system and method that provides adaptive color and contrast for a display device.

BACKGROUND OF THE INVENTION

A display device renders input data as a two-dimensional image in color or grayscale. The input data may be graphical in nature. An example of such a device is a PC display monitor. The input data may be a video signal. An example of such a device is a TV or video monitor. The input data may be a combination of graphics and embedded video. An example of such a device is a PC display monitor displaying graphics with one or applications displaying video in a window, or a PC/TV display device with two or more input ports displaying graphics or full-screen video or a combination of graphics and video, e.g. Picture-in-Picture.

A viewer typically manually controls the color and contrast of a display device. The issue with manual control is that it does not result in optimal display quality for all possible input data. For example, setting the contrast control to increase the contrast of a washed out image will result in over-contrasty images for a normal image. Decreasing the color saturation setting for a highly saturated image would be optimal, but if the input changes to a de-saturated image, this setting would now be sub-optimal. It is not feasible or convenient for a viewer to continuously change display settings to adapt to the nature of the input image, particularly when the input is a video sequence.

Another problem with manual control of contrast and color is that it is not sensitive to the nature of the input data. Manual contrast control applies a multiplicative factor to the input luma component. This is shown graphically in FIG. 1. Due to the finite dynamic range of luma values, increasing the contrast of a dark image in order to be able to see the shadow details results in loss of information in the bright highlights. The multiplicative nature of this control also implies that there is no possibility of increasing the contrast of a predominantly bright image.

Accordingly, what is needed is a system and method to address the above-identified problems. The present invention addresses such a need.

SUMMARY OF THE INVENTION

A method and apparatus that allows a display device to adaptively and automatically control display contrast and color is disclosed. The method and system in accordance with the present invention can be described by the following sequential process:

1. Separating an input image data value into its luma and chroma components.

2. Collecting the luma distribution data over the entire image or a specified window.

3. Analyzing the luma distribution.

4. Generating an appropriate contrast control response that modifies the input luma component to generate an output luma component, on a pixel by pixel basis.

5. Analyzing the input luma component and the output luma component, and an input chroma component, to generate an appropriate modification for the chroma component, on a pixel by pixel basis.

DETAILED DESCRIPTION

The present invention relates generally to display devices and particularly to a system and method that provides adaptive color and contrast for a display device. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

Digital Display Device: an electronic image display device that uses digitized (sampled and quantized) image data. The input data itself may be analog in nature, and digitized within the device for display on a digital display such as an LCD, OLED or plasma panel. Alternatively, the input data itself may be digital in nature and finally displayed on an analog display such as a CRT.

Pixel: the smallest discrete region on a digital display device that can be addressed for display.

Luma: the component of the input image data value that is correlated to the perceived intensity of the displayed data value.

Chroma: the component of the input image data value that is correlated to the perceived color of the displayed data value. Hue and saturation are two commonly used color perceptions that together define the chroma value.

A system and method in accordance with the present invention continuously analyzes the input data and responding by manipulating the color and contrast of the display device. The system is both adaptive and automatic. The term adaptive is used to signify that the proposed solution continuously generates an appropriate response based on an analysis of the input data. The term automatic is used to signify that there is no viewer interaction required for this process.

The apparatus in accordance with the present invention may be hardware, software, or a combination of hardware and software. An example of a pure hardware solution would be an FPGA or ASIC design. An example of a hardware and software implementation would be a DSP and embedded firmware.

Figure 1:
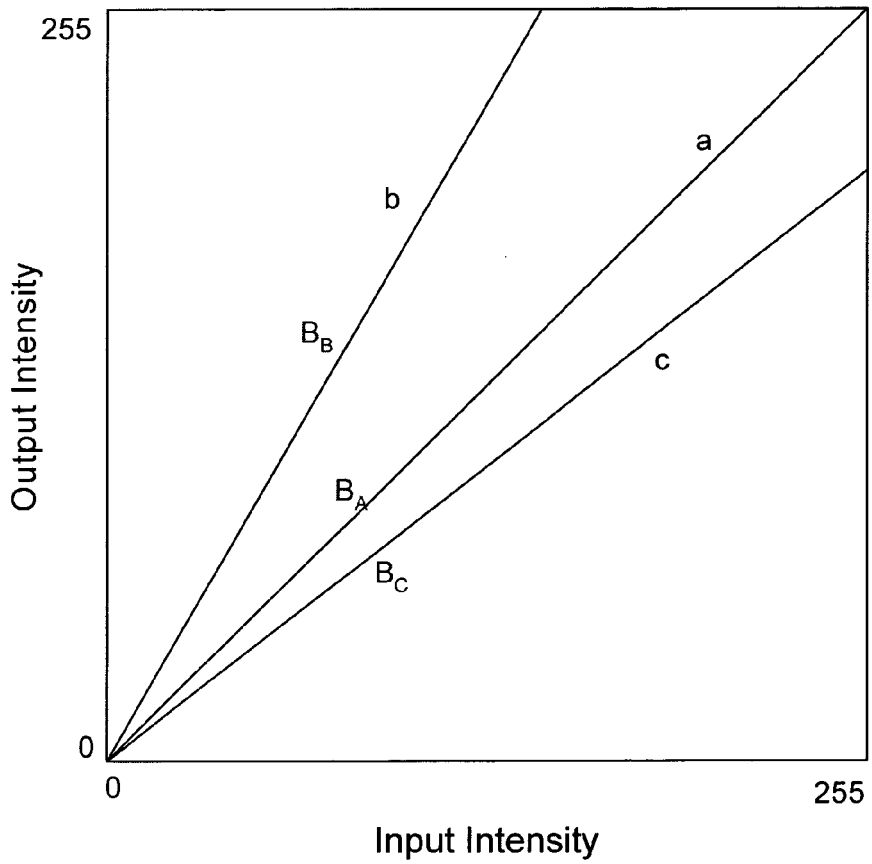
FIG. 1 illustrates a standard contrast adjustment.
Figure 2:
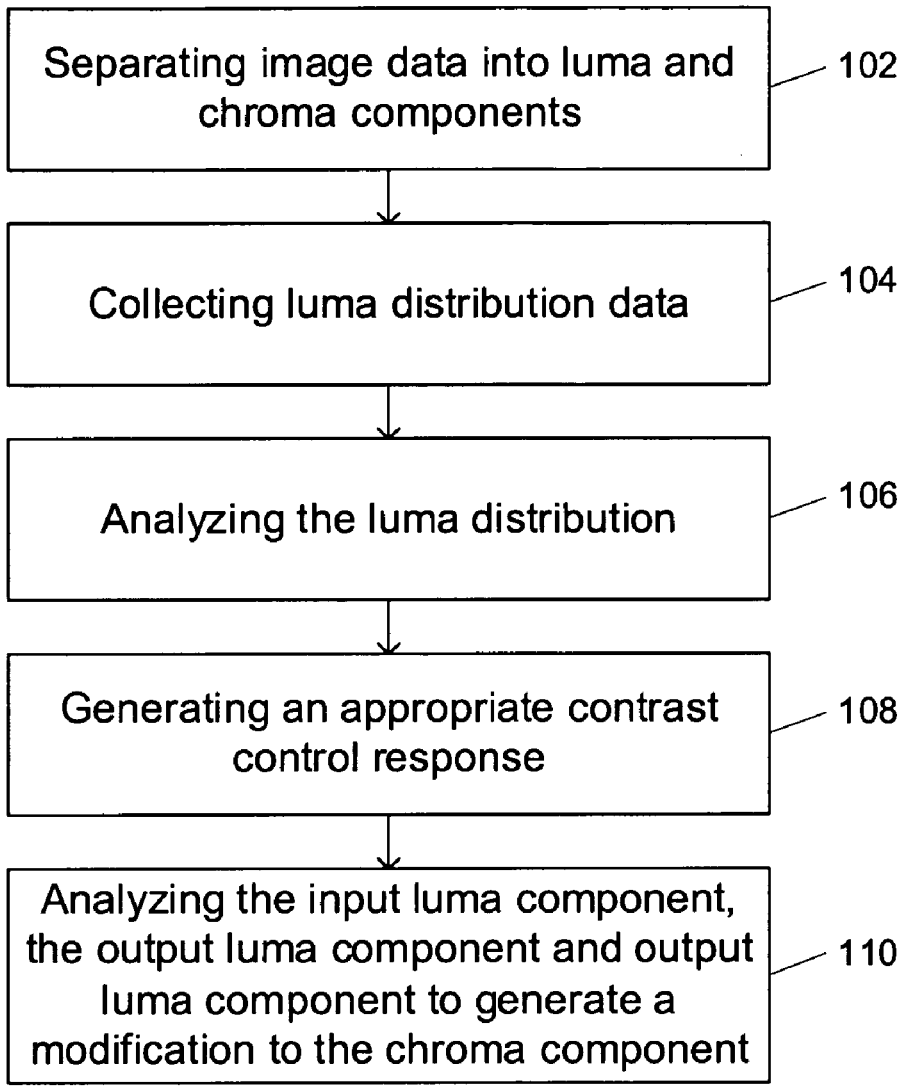
FIG. 2 is a flow chart illustrating adaptive color contrast in accordance with the present invention.

The method and system in accordance with the present invention is described in a preferred embodiment by the below-identified sequential steps in conjunction with FIG. 2. FIG. 2 is a flow chart illustrating adaptive color contrast in accordance with the present invention.

1. Separating an input image data value into its luma and chroma components, via step 103.
2. Collecting the luma distribution data over the entire image or a specified window, via step 104.
3. Analyzing the luma distribution, via step 106.
4. Generating an appropriate contrast control response that modifies the input luma component to generate an output luma component, on a pixel by pixel basis, via step 108.
5. Analyzing the input luma component and the output luma component, and an input chroma component, to generate an appropriate modification for the chroma component, on a pixel by pixel basis, via step 110.

Each of the steps will be described in detail hereinbelow.

Separating Input Data into Luma and Chroma Components (Step 102).

If the input data is already formatted as luma+chroma, this process is not required. If the input is in some other format, such as RGB, this process will generate the luma and chroma components.

Collecting Luma Distribution Data (Step 104).

This process divides the range of luma values into a number of overlapping bands and counts the number of input luma data values that fall within each of these bands, over the entire image or a specified window in the image. An image window will normally be specified when the desired control response needs to be confined to a window on the screen. This window could for example be a Picture-In-Picture video window, or an embedded video window within a graphics screen.

At the end of this process, the luma distribution is defined by a set of band indices and their corresponding counts. This statistical distribution table is the luma histogram.

In addition, the darkest and brightest luma data values found are also stored. These values can be either determined by the actual minimum and maximum values found in the image, or from a cumulative analysis of the luma histogram. For example, the minimum luma could be determined as the value beyond which 99% of the image luma values are found. The maximum luma could be determined as the value below which 99% of the image luma values are found.

Analyzing Luma Distribution Data (Step 106).

If the input data luma range is very evenly distributed over the range from black to white, this will reflect in the count values being approximately equal. If the input data luma values are clustered around certain portions of the entire range, this will reflect in different count values for different bands.

For example, a relatively high count in the lower bands corresponds to a predominantly dark image. A relatively high count in the upper bands corresponds to a predominantly bright image. A relatively high count in the middle bands corresponds to a mid-tone image. For each of these image categories, it is possible to pre-define an optimal contrast control response.

Figure 3:
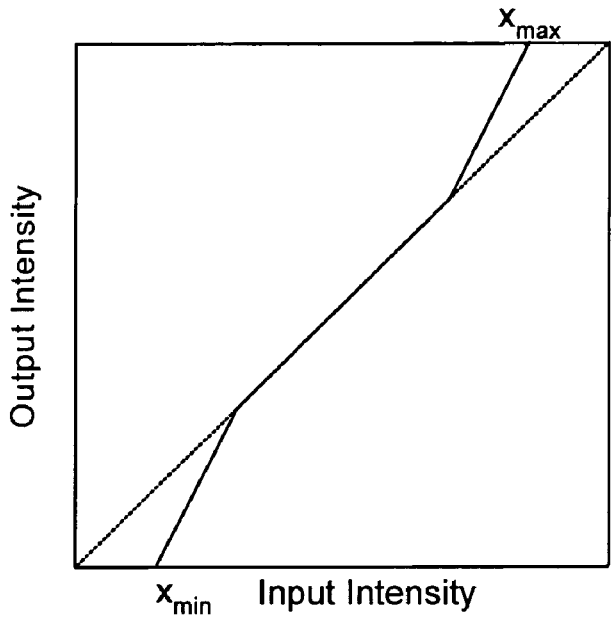
FIG. 3 illustrates a "snapping" process.

The darkest and brightest luma data values indicate the dynamic range of the input luma data. If this is less than the available dynamic range available, it is desirable to remap the luma values to fully utilize the available dynamic range for maximum visual quality. For example, assuming a normalized luma range of 0 to 1, if the darkest luma value is 0.2 and the brightest luma value is 0.9, it is possible to remap the input range of 0.2–0.9 to the range 0.0–1.0. This "snapping" process is shown in FIG. 3.

Generating Appropriate Contrast Control Response (Step 108).

Figure 4A:
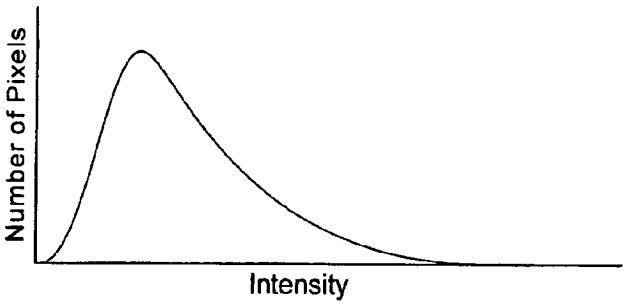
FIG. 4A illustrates the dark range case.
Figure 4B:
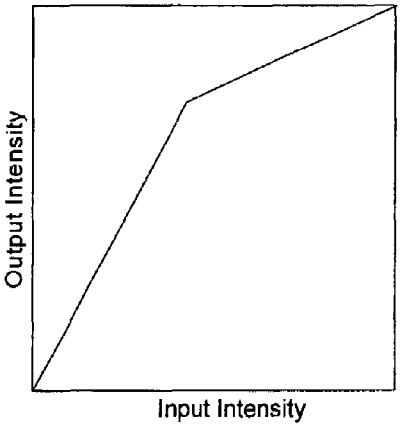
FIG. 4B illustrates the transfer function of the dark range case of FIG. 4A.

This method specifies an optimal contrast control response for a limited subset of the universe of possible luma distributions. For example, if three luma bands are used for analysis, it is possible to specify three control responses that are optimal for the following cases:

Dark image: relatively high band count in first band, compared to other two bands Mid-tone image: relatively high band count in middle band, compared to other two bands Bright image: relatively high band count in last band, compared to other two bands For the dark image case, a suitable contrast control response expands the dark image pixel dynamic range, and compresses the bright pixel dynamic range. FIG. 4 illustrates the dark range case and its transfer function.

Figure 5A:
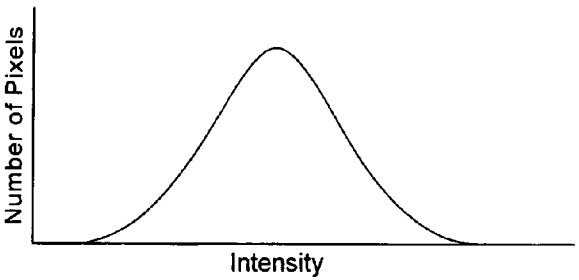
FIG. 5A illustrates the mid-tone range case.
Figure 5B:
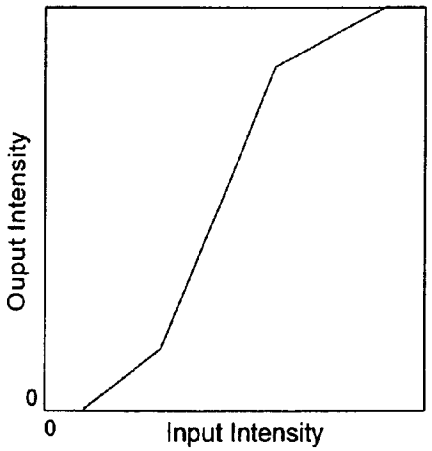
FIG. 5B illustrates the transfer function of the mid tone range case of FIG. 5A.

For the mid-tone image case, a suitable contrast control response expands the mid-tone dynamic range, and compresses the dark and bright image dynamic range. FIG. 5 illustrates the mid-tone range case and its transfer function.

Figure 6A:
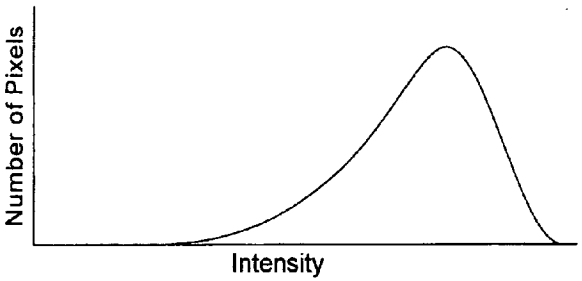
FIG. 6A illustrates the bright range case.
Figure 6B:
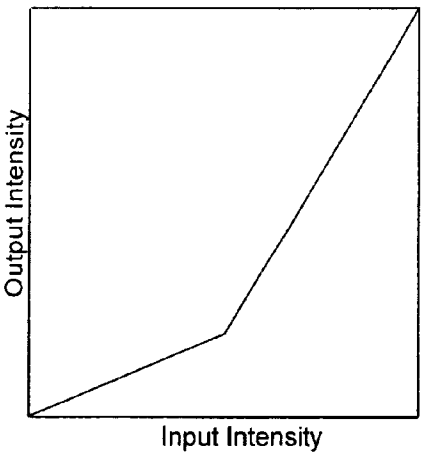
FIG. 6B illustrates the transfer function of the bright range case of FIG. 6A.

For the bright image case, a suitable contrast control response expands the bright pixel dynamic range and compresses the dark pixel dynamic range. FIG. 6 illustrates the bright range case and its transfer function.

These control responses are user definable so that any desired contrast control can be applied.

For an actual input luma distribution, the relative luma counts in the different bands are used to determine how well the actual luma distribution correlates to the chosen subset of luma distributions.

This method then blends the predefined control responses for the subset of luma distributions using the relative luma counts as a blending weight. For example if the actual luma counts are relatively high in both dark and mid-tone bands and low in the bright region, the blending process will generate a control response that is predominantly a blend of the appropriate control responses for dark images and mid-tone images.

Figure 7:
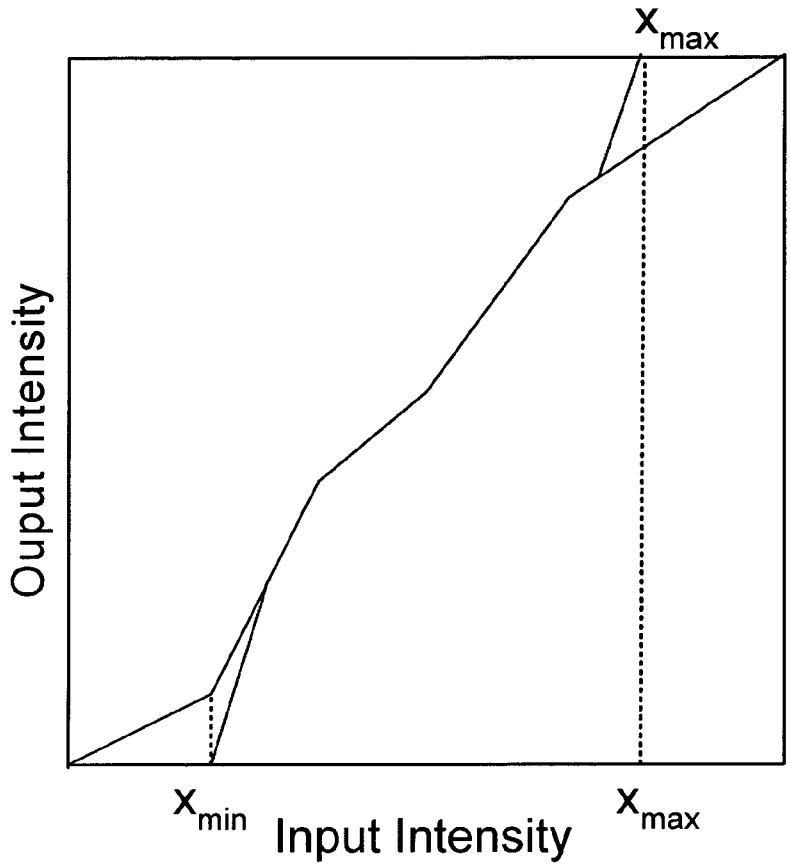
FIG. 7 illustrates modifying the blended contrast control response so that display dynamic range is fully utilized.

Finally, the computed darkest (Xmin) and brightest (Xmax) luma values are used to modify the blended contrast control response so that display dynamic range is fully utilized. This is shown in FIG. 7.

Analyzing Modified Luma Followed by Generation of Non-Linear Chroma Correction Factor (Step 110).

This method analyzes on a pixel by pixel basis the incoming luma value and outgoing modified luma value, and generates an appropriate adjustment for the chroma component. The chroma adjustment maintains or enhances the perceived color saturation of the picture when the contrast has been increased.

The chroma correction applied is determined by the difference between the luma output and the luma input to the luma LUT and is non-linear. If the incoming pixel already is highly saturated, the amount of additional chroma correction is decreased.

Figure 8:
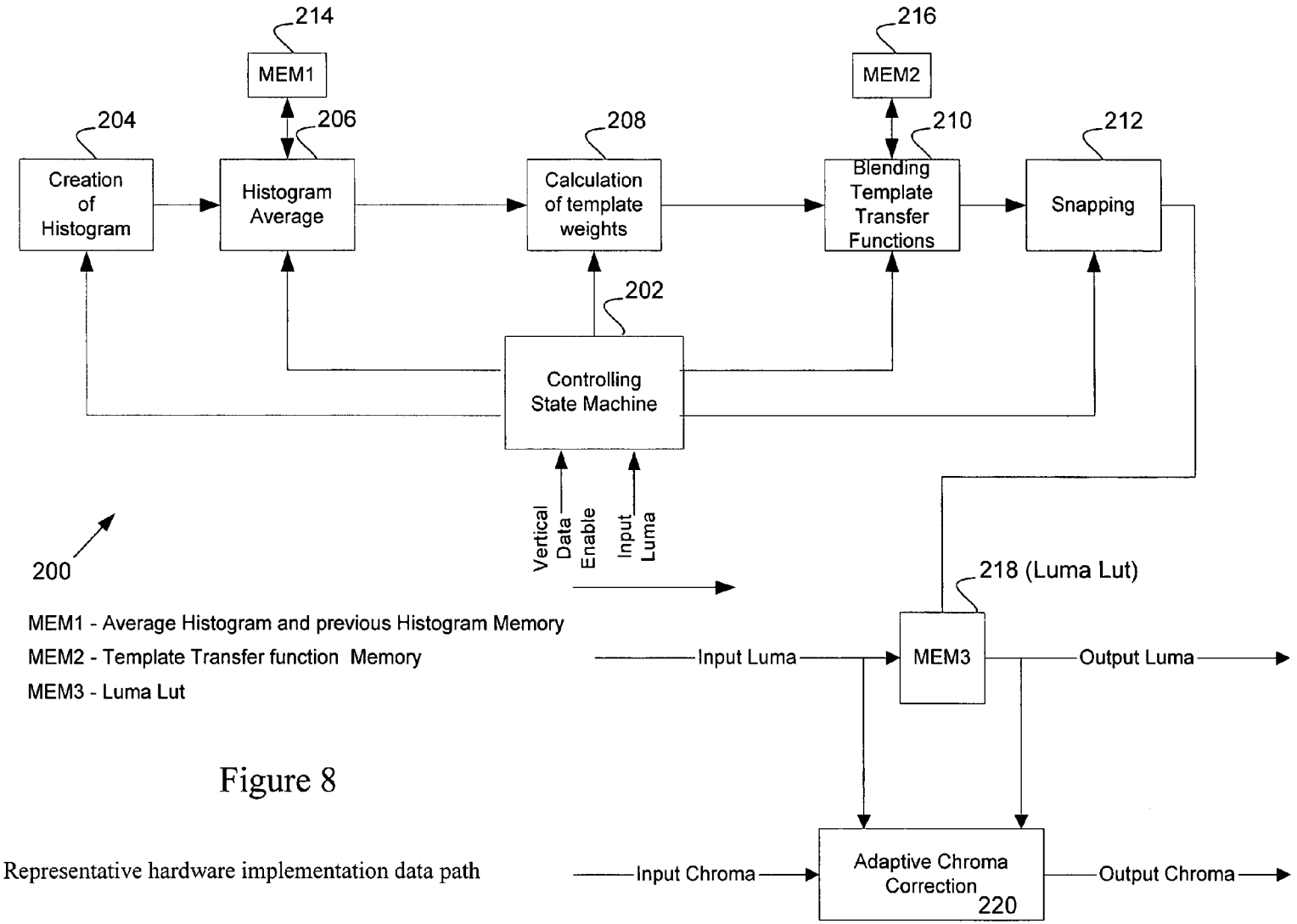
FIG. 8 shows a representative hardware data path diagram.

A representative hardware data path diagram 200 is shown in FIG. 8. In this figure, a controlling state machine 202, receives a vertical data enable signal and an input luma signal. The state machine 202 controls a creation of histogram block 204, a histogram average 206, template weight calculator 208, a template transfer function block 210 and a snapping function block 212. Memory 214 stores average histogram and the previous histogram. Memory 216 stores the template transfer function.

The snapping function block 212 provides final blended transfer function to memory 218. The memory receives input luma and provides an output luma. The input luma, output and the input chroma is provided to the adaptive chroma correction block 220. The adaptive chroma correction block provides the output chroma.

In this system, the collection of the current image histogram is performed during the active frame which is signaled, for example, by the vertical data enable signal at logic 1. When the vertical inactive period (blanking) starts, the histogram is averaged if necessary with previous image histograms. Then the template transfer function weights are calculated and the template transfer functions are blended using these weights. Finally the snapping operation is done on the blended output to recover the full dynamic range and the new contrast transfer function is written to the luma LUT memory. This new lookup table is used for the next image frame.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for adaptive color contrast of an image displayed on a display device, comprising:

separating input data into luma and chroma components;

collecting luma distribution data;

analyzing the luma distribution data;

generating appropriate contrast control response based upon the analyzed luma distribution data;

modifying the incoming luma component based upon the contrast control response;

analyzing the modified luma component; and generating a non-linear chroma correction factor based upon the analyzed modified luma component.

2. The method as recited in claim 1, wherein the collecting comprises:

dividing a range of luma values into a number of overlapping bands;

counting a number of input luma values that fall within each of the overlapping bands over the entire image or a specified window in the image wherein the image window is specified when the contrast control response is confined to the window on the display; and defining a luma histogram as a set of band indices and their corresponding counts.

3. The method as recited in claim 2, wherein the specified window is a Picture-In-Picture video window or an embedded video window within a graphics screen.

4. The method as recited in claim 2, wherein based upon the luma histogram, determining a darkest luma value and a brightest luma value based upon the luma histogram; and storing the darkest and the brightest luma values.

5. The method as recited in claim 4, further comprising:

specifying an optimal contrast control response for a limited subset of the universe of possible luma distributions wherein the optimal control responses are user definable so that any desired contrast control can be applied.

6. The method as recited in claim 5, further comprising, if the input data luma range is evenly distributed over the range from black to white, then the count values are approximately equal, wherein if the input data luma values are clustered around certain portions of the entire range, then different count values are counted for different bands.

7. The method as recited in claim 6, wherein a relatively high count in the lower bands corresponds to a predominantly dark image wherein a relatively high count in the upper bands corresponds to a predominantly bright image, and wherein a relatively high count in the middle bands corresponds to a mid-tone image.

8. The method as recited in claim 7, further comprising:

specifying an optimal contrast control response for a limited subset of the universe of possible luma distributions wherein the control responses are user definable so that any desired contrast control can be applied.

9. The method as recited in claim 8, further comprising:

calculating the relative luma counts in the different bands;

determining how well the actual luma distribution correlates to the chosen subset of luma distributions based upon the relative luma counts; and blending the predefined control responses for the subset of luma distributions using the relative luma counts as a blending weight.

10. The method as recited in claim 9, further comprising:

using the computed darkest (Xmin) and brightest (Xmax) luma values to modify the blended contrast control response such that display dynamic range is fully utilized.

11. Computer program product for adaptive color contrast of an image displayed on a display device, comprising:

computer code for separating input data into luma and chroma components;

computer code for collecting luma distribution data;

computer code for analyzing the luma distribution data;

computer code for generating appropriate contrast control response based upon the analyzed luma distribution data;

computer code for modifying the incoming luma component based upon the contrast control response;

computer code for analyzing the modified luma component;

computer code for generating a non-linear chroma correction factor based upon the analyzed modified luma component; and computer readable medium for storing the computer code.

12. Computer program product as recited in claim 11, wherein the collecting comprises:

computer code for dividing a range of luma values into a number of overlapping bands;

computer code for counting a number of input luma values that fall within each of the overlapping bands over the entire image or a specified window in the image wherein the image window is specified when the contrast control response is confined to the window on the display; and computer code for defining a luma histogram as a set of band indices and their corresponding counts.

13. Computer program product as recited in claim 2, wherein the specified window is a Picture-In-Picture video window or an embedded video window within a graphics screen.

14. Computer program product as recited in claim 2, wherein based upon the luma histogram, determining a darkest luma value and a brightest luma value based upon the luma histogram; and computer code for storing the darkest and the brightest luma values.

15. Computer program product as recited in claim 14, further comprising:

computer code for specifying an optimal contrast control response for a limited subset of the universe of possible luma distributions wherein the optimal control responses are user definable so that any desired contrast control can be applied.

16. Computer program product as recited in claim 15, further comprising, if the input data luma range is evenly distributed over the range from black to white, then the count values are approximately equal, wherein if the input data luma values are clustered around certain portions of the entire range, then different count values are counted for different bands.

17. Computer program product as recited in claim 16, wherein a relatively high count in the lower bands corresponds to a predominantly dark image wherein a relatively high count in the upper bands corresponds to a predominantly bright image, and wherein a relatively high count in the middle bands corresponds to a mid-tone image.

18. Computer program product as recited in claim 17, further comprising:

computer code for specifying an optimal contrast control response for a limited subset of the universe of possible luma distributions wherein the control responses are user definable so that any desired contrast control can be applied.

19. Computer program product as recited in claim 18, further comprising:

computer code for calculating the relative luma counts in the different bands;

computer code for determining how well the actual luma distribution correlates to the chosen subset of luma distributions based upon the relative luma counts; and computer code for blending the predefined control responses for the subset of luma distributions using the relative luma counts as a blending weight.

20. Computer program product as recited in claim 19, further comprising:

computer code for using the computed darkest (Xmin) and brightest (Xmax) luma values to modify the blended contrast control response such that display dynamic range is fully utilized.

* * * * *